US005794348A

United States Patent [19]

Scott

[11] Patent Number: 5,794,348

[45] Date of Patent: Aug. 18, 1998

[54] CLIPPER COMB

[76] Inventor: Mike Scott, 1195 Brafforton Dr., Tallahassee, Fla. 32312

[21] Appl. No.: 720,429

[22] Filed: Oct. 1, 1996

[51] Int. Cl.[6] ..... B26B 21/12

[52] U.S. Cl. ..... 30/195; 30/30; 30/220; 30/233.5

[58] Field of Search ..... 30/30, 195, 228, 30/233.5, 277.4, 220, 295; 132/148; 200/334, 523, 522; 83/DIG. 1

[56] References Cited

U.S. PATENT DOCUMENTS

| | | | |
|---|---|---|---|
| 3,570,121 | 3/1971 | Graceffo | 30/30 |
| 3,885,305 | 5/1975 | Spanel | 30/30 |
| 3,914,866 | 10/1975 | Applegate | 30/233.5 |
| 4,009,517 | 3/1977 | Horn | 30/30 |
| 4,020,544 | 5/1977 | Edwards | 30/30 |
| 4,146,960 | 4/1979 | Flowers et al. | 30/195 |
| 4,159,566 | 7/1979 | Patrin | 30/30 |
| 4,401,129 | 8/1983 | Lugue | 132/45 |
| 4,487,211 | 12/1984 | Sillivan | 132/45 |
| 4,505,283 | 3/1985 | Pischdotchian | 132/45 |
| 4,663,841 | 5/1987 | Custer | 30/30 |
| 4,709,475 | 12/1987 | Phuny | 30/31 |
| 4,922,069 | 5/1990 | Huizenga | 200/334 |
| 5,012,582 | 5/1991 | Bristol et al. | 30/390 |
| 5,131,418 | 7/1992 | Vaccaro | 132/213.1 |
| 5,259,114 | 11/1993 | Shorter | 30/131 |
| 5,361,499 | 11/1994 | Janaway et al. | 30/277.4 |
| 5,414,793 | 5/1995 | Morikawa | 200/522 |
| 5,450,671 | 9/1995 | Harshman | 30/31 |

*Primary Examiner*—Hwei-Siu Payer
*Attorney, Agent, or Firm*—Peter Loffler

[57] ABSTRACT

A clipper comb is comprised of a handle having a motor, responsive to an activation button depression, disposed therein. A cutting assembly, having a comb and a cutter with a plurality of blades such that in a normally relaxed state each blade overlies a comb tooth, is removably attached to the handle. Motor activation causes the blades to cut hair held within the openings defined between each comb tooth. A dual-topped cam assures blade alignment. An alternate embodiment comprises a single blade that cuts across all tooth opening upon motor activation. A deadman switch assures blade alignment.

19 Claims, 5 Drawing Sheets

CLIPPER COMB

BACKGROUND OF THE INVENTION

1. Field of the Invention

The present invention relates to a hair grooming tool capable of combing and cutting hair.

2. Background of the Prior Art

In cutting and styling hair, the stylist uses one hand to comb the hair in order to draw the hair up for cutting. Once the desired strands of hair are drawn up by the comb, the stylist holds the hair with the opposite hand, with or without the comb, and then uses the original hand to hold a cutting implement, such as a pair of scissors, to cut the hair being held by the opposite hand. While this standard method of cutting hair produces a hair cut of sufficient quality, this method is very inefficient in that it requires a multiplicity of movements by both hands of the stylist.

In having to use one hand to draw the hair up for cutting and thereafter switching the drawn hair and use the initial hand to perform the cut, the stylist is required to use both hands to perform the hair cut. Although this requirement is not very significant for any one hair cut, a full week of cutting hair will leave both hands very tired. Furthermore, the cutting hand, by opening and closing a pair of scissors on a continual basis, will suffer muscle fatigue.

An additional problem with the traditional hair cut method is safety. People, especially children, tend to move around during a hair cut. If a person moves into the path of a scissors blade—which tend to be particularly sharp—a gash can occur.

Therefore, there is a need in the art for a device that increases the efficiency of cutting hair. Such a device must be capable of performing a hair cut without the requirement of using both hands a substantial amount of time. The device must be of relatively simple and straightforward design and should enhance hair cut safety. The device must be easy to use and must be capable of performing a hair cut that is, at a minimum, of at least the same quality as is available with the present method.

SUMMARY OF THE INVENTION

The clipper comb of the present invention addresses the aforementioned needs in the art. The clipper comb provides a unitary tool that performs the combing as well as the cutting operation.

The clipper comb is comprised of a handle having a combing unit removably attached thereto. The combing unit comprises a shaft having a plurality of comb teeth extending therefrom. A cutting unit is secured to a piston which is adapted to slide within the shaft. The cutting unit is comprised of a plurality of either single-sided or double-sided cutting blades positioned to overlay the comb teeth in a normally relaxed state. Upon depression of an activation button located on the handle, the blades are thrust forward so that the blades articulate across the opening between the comb teeth and cut any hair located therebetween. Thereafter, the cutting unit is returned to its normally relaxed state by a bias spring.

Alternately, the cutting unit can be comprised of a single cutting blade that is located at the base of the shaft in the cutting unit's normally relaxed state. Upon depression of the activation button, the blade is driven forward so that the blade sweeps across all the openings between the comb teeth and cuts any hair located therebetween. Thereafter, the cutting blade is returned to its normally relaxed state.

By combining the cutting implement and the combing implement in a single unit having a single handle, the use of a second hand for performing the hair cutting process is diminished. As the dominant hand is not required to continually open and close a pair of scissors, muscle fatigue will not occur.

The stylist can use a single device in order to comb the hair into cutting position and, upon depression of a single button, cut the hair and thereafter repeat the cycle. The device relieves much of the labor intensiveness of performing a hair cut and also saves time required to perform the cut.

The device increases the safety of a hair cut as an open blade is not longer exposed. The teeth of the comb act as a barrier to the sharp blade held at the base of the comb portion. If a person accidentally shifts his head into the present device, the comb portion will act as a barrier from the sharp blades. As the device requires only occasional motor operation, a child will tend to be less fearful of the device as compared to the constant buzz of current clipper machines.

The device is of relatively simple and straightforward design and can be made using standard manufacturing techniques. The device is easy to use and maintain and will match the cutting quality of the standard comb and scissors method.

BRIEF DESCRIPTION OF THE DRAWINGS

Similar reference numerals refer to similar parts throughout the several views of the drawings.

DETAILED DESCRIPTION OF THE PREFERRED EMBODIMENT

Figure 1:
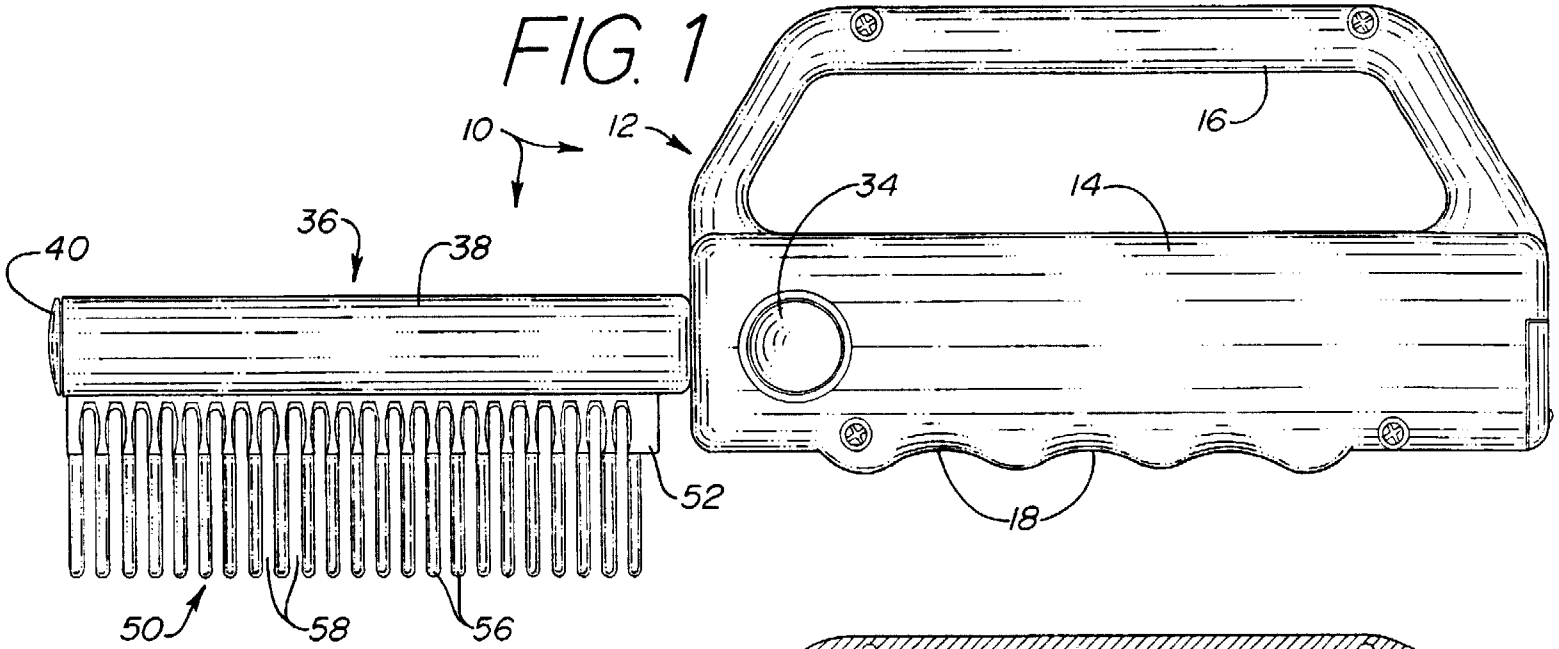
FIG. 1 is a side elevation view of the clipper comb of the present invention.
Figure 2:
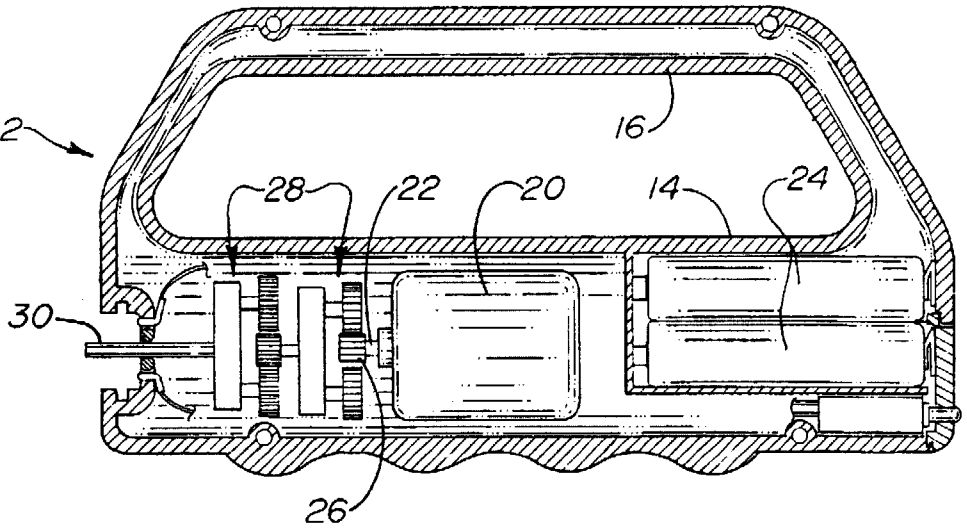
FIG. 2 is a cutaway view of the handle unit of FIG. 1.

Referring now to the drawings, it is seen that the clipper comb of the present invention, generally denoted by reference numeral 10, is comprised of a handle unit 12. As seen in FIG. 1, the handle unit 12 has a hand grip 14 and a hand guard 16. If desired, the hand grip 14 can have contoured finger grooves 18 located thereon. As seen in FIG. 2, a motor 20 having a motor shaft 22 extending therefrom, is disposed within the hand grip 14. The shaft 22 rotates in response to motor 20 activation. Motor power can be provided by a wall socket attachment (not illustrated), or, advantageously, from a battery unit 24 that is preferably rechargeable. A gear head 26, located on the end of the motor shaft 22, communicates with a gear assembly 28 which in turn communicates with a cut shaft 30. However, it is expressly recognized that the gear head 26, gear assembly 28 and cut shaft 30 can be completely eliminated. A dual-top cam 32 is located on the end of the cut shaft 30 (or the motor shaft 22 if no gear assembly 28 is utilized).

An activation button 34 provides activation for the motor 20 such that depression of the button 34 causes motor 20 activation. The button 34 can be located on either side of the hand grip 14, or for ambidexterity purposes, on both sides of the hand grip 14.

A cutting unit 36 is removably securable to the handle unit 12. As seen in FIGS. 1, and 3–6, the cutting unit 36 is comprised of a hollow shaft 38 having an end cap 40 removably attached thereto. Flanges 42 extend downwardly from either end of the shaft 38. A piston 44 is adapted to slide within the shaft 38. One end of the piston 44 has a roller assembly 46. A spring 48 abuts the opposing end and the end cap 40.

Figure 5:
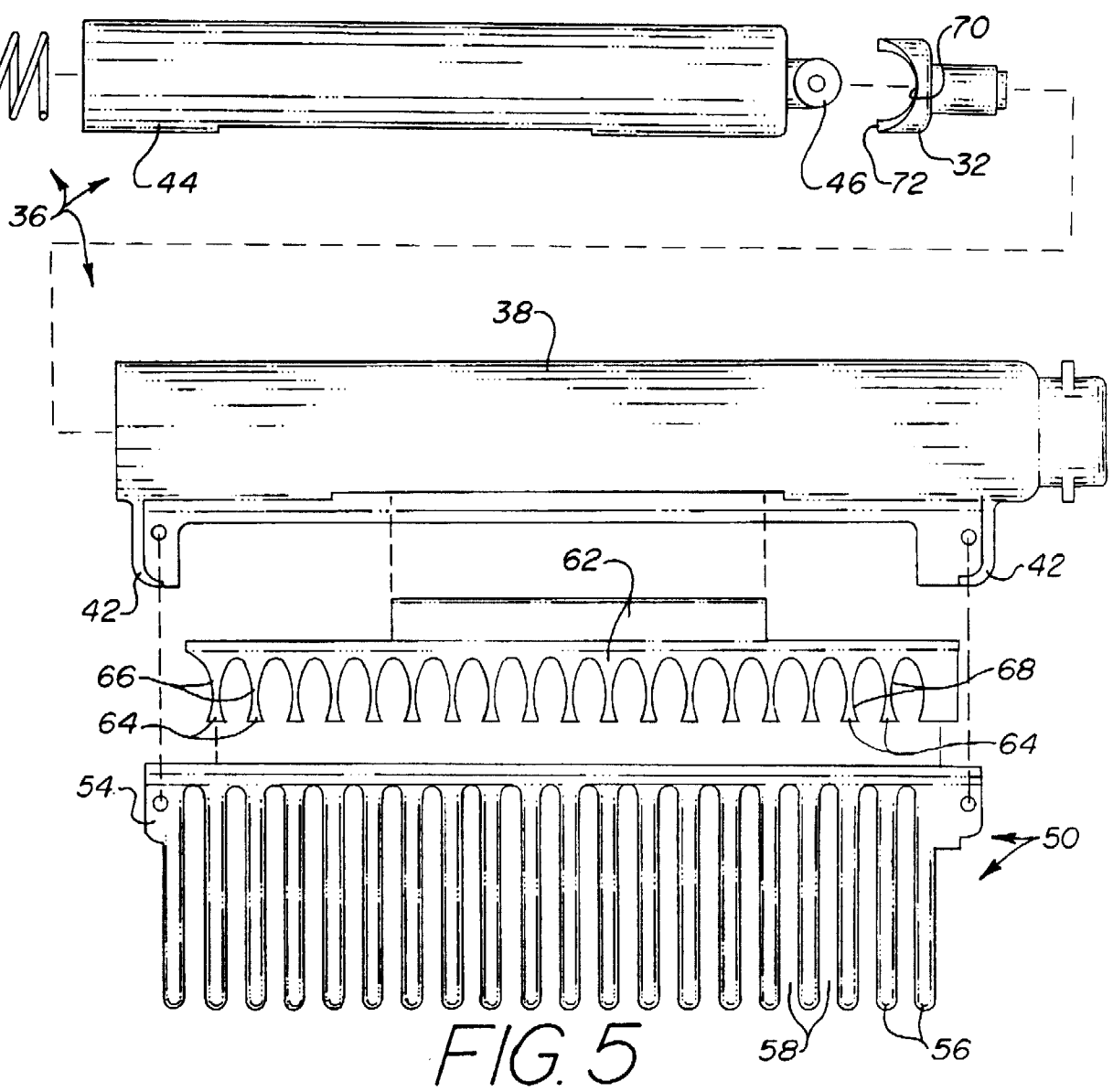
FIG. 5 is an exploded view of the combing unit of FIG. 1.
Figure 6:
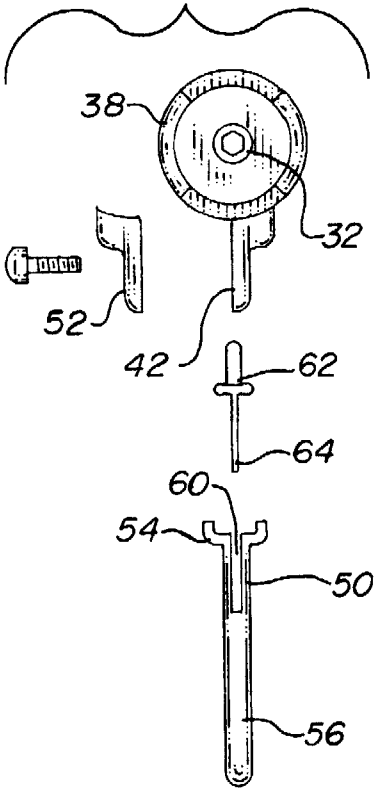
FIG. 6 is a rotated view of FIG. 5.

A comb 50 is secured to the flanges 42 of the shaft 38 by a plate 52. As seen in FIGS. 5 and 6, the comb 50 has a base portion 54 and a plurality of teeth 56 extending therefrom. Teeth openings 58 are defined between the teeth 56. As seen in FIG. 6, the base 54 has an opening 60 located therebetween. A cutter 62 having a plurality of cutting blades 64, is adapted to slide within the opening 60 and is secured to the piston 44. The leading edge 66, and if desired, the trailing edge 68 of each cutting blade 64 is sharpened.

Figure 3:
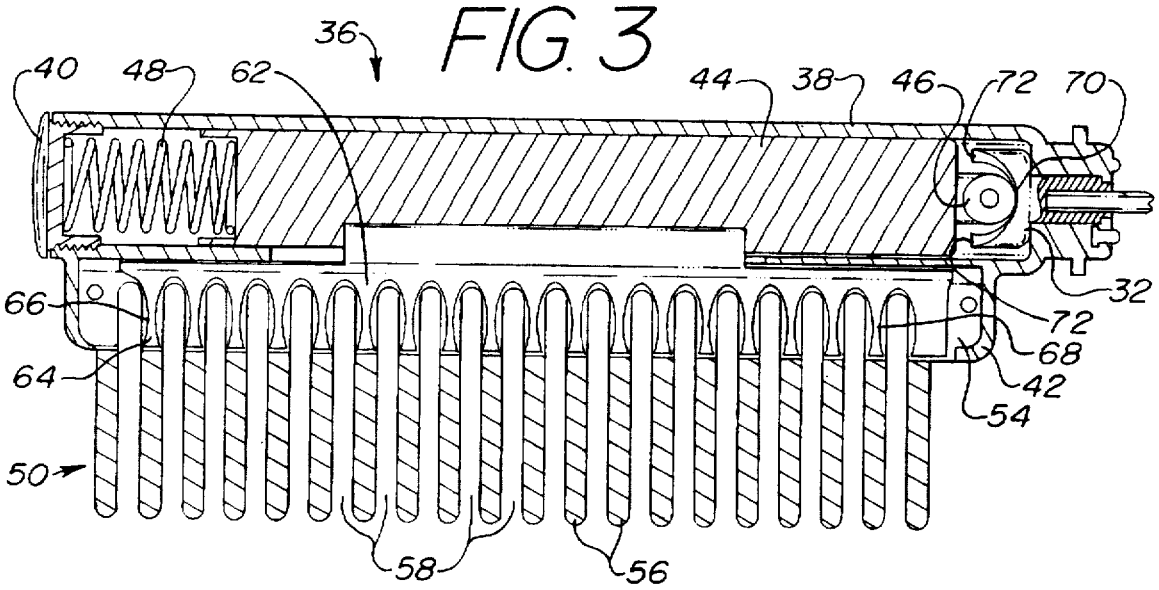
FIG. 3 is a cutaway view of the combing unit of FIG. 1 in a normally relaxed state.
Figure 4:
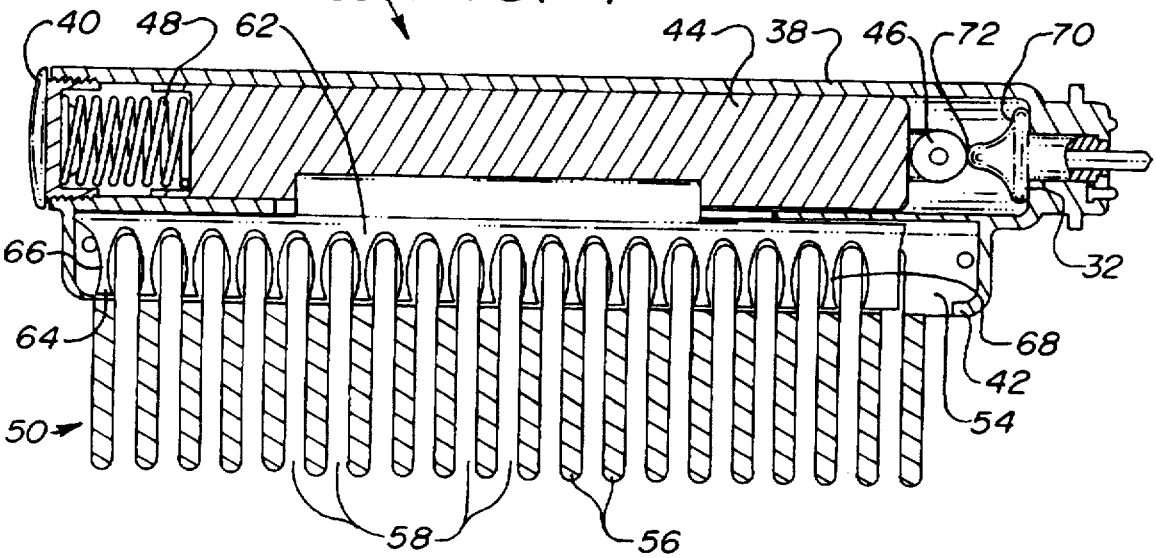
FIG. 4 is a cutaway view of the combing unit of FIG. 1 in an articulated cut state.

As seen in FIG. 3, in a normally relaxed state, the cutter 62 is aligned such that the cutting blades 64 overlay the comb's teeth 56 thereby keeping the teeth openings 58 open. In this position, the cam 32 is positioned such that the roller assembly 46 is disposed within the valley 70 formed between the dual tops 72 of the cam 32.

In order to utilize the clipper comb 10 of the present invention, a stylist grasps the device 10, which is in a normally relaxed state, by the hand grip 14 and combs the hair in the usual way. Upon retrieving the desired strands of hair and holding same within the teeth openings 58, the user depresses the button 34 causing activation of the motor 20. This causes rotation of the cut shaft 30 (if used) via the motor shaft 22 and gear assembly 28 which in turn causes rotation of the cam 32. Rotation of the cam 32 causes the roller assembly 46 to ride from the valley 70 to one of the tops 72 of the cam 32, causing the piston 44 and the secured cutter 62 to thrust forward toward the end cap 40. This causes the blades 64 to slide across their respective teeth openings 58 cutting any hair held therein.

Once the roller assembly 46 reaches the top 72 of the cam 32, the piston 44 has reached a position such that the blades 64 of the cutter 62 overlay the teeth 56 of the comb 50, each blade 64 overlaying the tooth 56 next to the tooth 56 which the blade 64 overlays in the relaxed state. The motor 20 and gear assembly 28, if used, are designed such that one depression of the button 34 will cause 180 degree rotation of the cam 32 for completing one cutting cycle. As the cam 32 continues rotating to complete the cutting cycle, the roller assembly 46 rollers back down from the top 72 toward the valley 70 of the cam 32. The spring 48 pushes the piston 44 and attached cutter 62 back toward the cam 32, causing the blades 64 to pass back across their respective teeth openings 58 back into the relaxed stated. If the trailing edges 68 of the blades 64 are sharpened, hair will also be cut during the cutter's return to the relaxed stated. Once the cam 32 ceases rotation, the roller assembly 46 rests within the valley 70, the blades 64 overlay their respective teeth 56 and the device 10 is ready to perform another cutting cycle.

For easy maintenance of the device 10, removal of the plate 52 permits removal of the comb 50. Thereafter, the cutter 62, which is snap fit into an opening (not illustrated) within the piston 44, can be removed and replaced. The piston 44 can be removed from the shaft 38 by removal of the end cap 40. The entire cutting unit 36 can be removably attached to the handle 12 in any appropriate fashion. If the batteries 24 are rechargeable, the device 10 can be secured within an appropriate recharge cradle 74.

Figure 7:
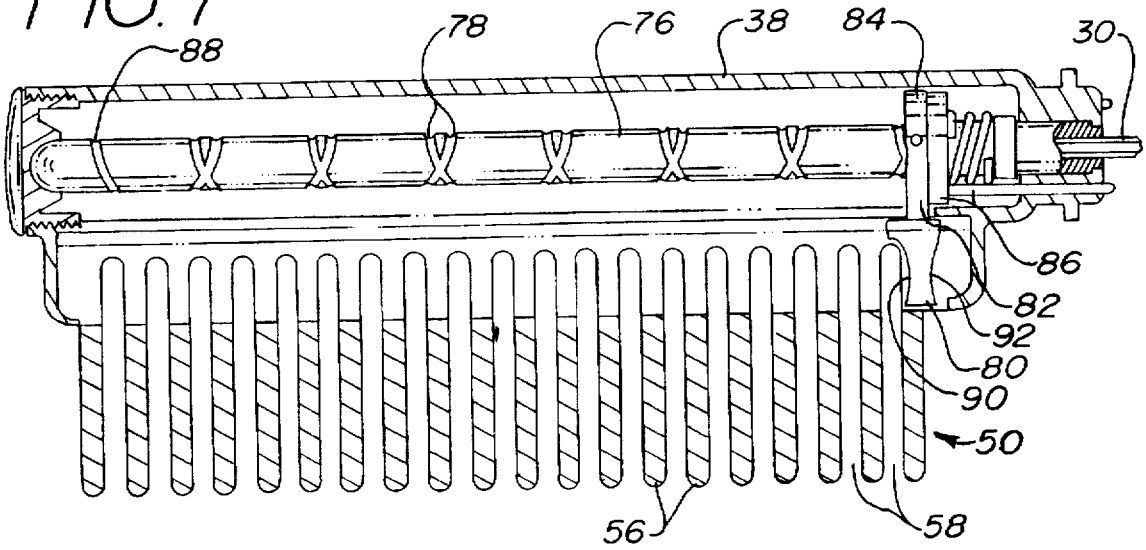
FIG. 7 is a cutaway view of an alternate embodiment of the combing unit in a normally relaxed state.
Figure 8:
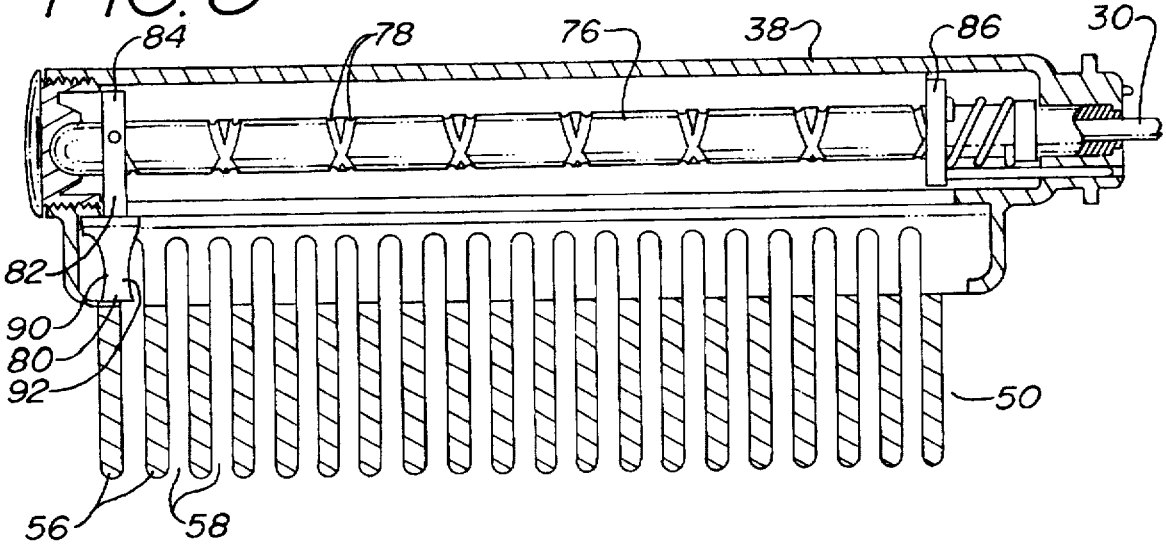
FIG. 8 is a cutaway view of an alternate embodiment of the combing unit in an articulated cut state.
Figure 9:
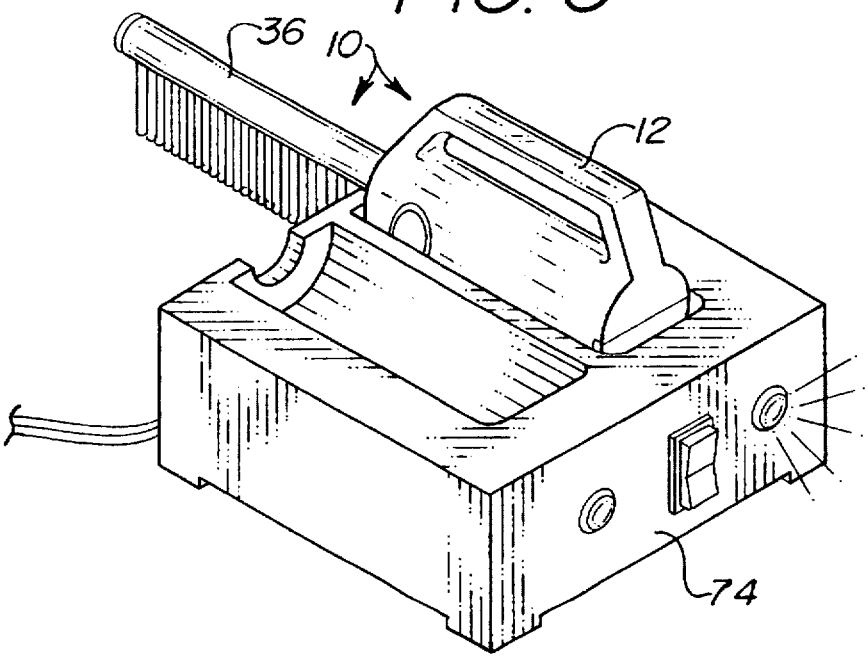
FIG. 9 is a view of the clipper comb of the present invention within a recharging unit.

As seen in FIGS. 7 and 8, an alternate embodiment of the clipper comb 10 has a worm gear 76, having a groove 78 thereon, attached to the end of the cut shaft 30 (or the motor shaft 22 if the cut shaft 30 is not utilized). A single cut blade 80, having a base 82 that has a guide 84 disposed within the groove 78 of the worm gear 76, is disposed within the comb opening 60. A deadman switch 86 is located on the end of the worm gear 76. Advantageously, the guide 84 will be non-circular in shape so that the guide 84 does not change direction during progression through the groove 78 whenever the groove 78 crosses over itself.

As seen in FIG. 7, in a normally relaxed state, the blade 80 is located at the end of the comb 50 proximate the handle 12. In this position, the deadman switch 86 is depressed. The stylist grasps the device 10, which is in a normally relaxed state, and combs the hair in the usual way. Upon retrieving the desired strands of hair and holding same within the teeth openings 58, the user depresses the button 34 causing activation of the motor 20. This causes rotation of the cut shaft 30 (if used) which in turn causes rotation of the worm gear 76. Rotation of the worm gear 76 causes the guide 84 to progress along the groove 78 causing the base 82 and the attached blade 80 to slide across the comb 50. The leading edge 90 of the articulating blade 80 cuts any hair held within the teeth openings 58. Upon reaching the end of the worm gear 76, the guide 84 passes through a return loop 88 causing reversal of the blade's direction. If the trailing edge 92 of the blade 80 is sharpened, the blade 80 will cut hair along the return trip. The motor 20 will continue shaft rotation until the base 82 depresses the deadman switch 86. Once the deadman switch 86 is depressed, the motor 20 ceases operation and the base 82 ceases articulation within the shaft 38. This positions the blade 80 over top the end tooth of the comb 50 ready to begin the next cutting cycle.

It is expressly understood that motor deactivation after activation can be achieved in any other appropriate fashion in addition to the above-described deadman switch 86 assembly. Motor deactivation can be achieved by positioning an electric or optical sensor in appropriate position for sensing passage of the blade 80 thereby and thus deactivating the motor 20. A timing or a manual deactivation assembly can also be utilized.

If desired, the button 34 can be designed with a fail-safe double depression feature such that motor 20 activation will occur only upon two depressions of the button 34. This feature can insure against accidental motor 20 activation by a single depression of the button 34.

If further desired, a variable rotation switch (not illustrated) can be positioned on the handle 12 so that the user can vary the cutting speed of the device 10. Alternately, the button 34 can have a variable depth depression feature wherein the speed of the motor 20 is directly proportional to the depth of button 34 depression.

The button 34 can, upon device activation, can be disabled until completion of the current cutting cycle, so that the device 10 will reset upon completion of a single cutting cycle, irrespective of the number of button 34 depressions during execution of the cutting cycle.

While the invention has been particularly shown and described with reference to an embodiment thereof, it will be appreciated by those skilled in the art that various changes in form and detail may be made without departing from the spirit and scope of the invention.

I claim:

1. A clipper comb comprising:

a handle;

a motor disposed within the handle;

a comb, having a base with an opening, a plurality of teeth and a plurality of teeth openings defined between each of the plurality of the teeth, attached to the handle;

a hollow first shaft having a first end attached to the handle and a second end;

a worm gear, having a groove, disposed and adapted to rotate within the first shaft;

a blade, having a leading edge, a trailing edge, and a base, adapted to slide within the opening;

a guide, attached to the base, disposed within and progressable through the groove in response to worm gear rotation; and transmission means, disposed intermediate and engagable with the motor and the worm gear, for rotation of the worm gear.

2. The clipper comb as in claim 1 wherein the second end is selectively removable from the first shaft.

3. The clipper comb as in claim 1 wherein the groove has a return loop.

4. The clipper comb as in claim 1 further comprising a deactivation means for deactivating the motor responsive to blade movement.

5. The clipper comb as in claim 4 wherein the deactivation means comprises a deadman switch.

6. The clipper comb as in claim 1 wherein the guide has a non-circular shape.

7. The clipper comb as in claim 1 wherein the trailing edge is sharpened.

8. The clipper comb as in claim 1 further comprising an end cap removably attached to the second end.

9. A clipper comb comprising:

a handle;

a motor disposed within the handle;

a comb, having a base with an opening, a plurality of teeth and a plurality of teeth openings defined between each of the plurality of the teeth, attached to the handle;

a hollow first shaft, having a first end attached to the handle and a second end, attached to the comb;

a piston adapted to slide within the first shaft;

a blade assembly, having a plurality of blades each with a leading edge and a trailing edge, attached to the piston and adapted to slide within the opening;

transmission means, disposed intermediate the motor and the piston for causing back and forth reciprocation of the piston within the first shaft; and activation means for activating the motor.

10. The clipper comb as in claim 9 wherein the transmission means comprises:

a second shaft, extending outwardly from the motor and rotatable in response to motor activation;

a dual top cam, having two opposing tops and a valley therebetween, attached to one end of the second shaft;

a roller assembly, attached to the piston and engaging the cam, reciprocatable between the valley and the two opposing tops responsive to cam rotation; and a spring abutting the second end.

11. The clipper comb as in claim 9 wherein the transmission means comprises:

a second shaft, extending outwardly from the motor and rotatable in response to motor activation;

a gear assembly engagable with the second shaft;

a third shaft having a first end engagable with the gear assembly and a second end;

a dual top cam, having two opposing tops and a valley therebetween, attached to the second end of the third shaft;

a roller assembly, attached to the piston and engaging the cam, reciprocatable between the valley and the two opposing tops responsive to cam rotation; and a spring abutting the second end of the first shaft.

12. The clipper comb as in claim 7 wherein the handle is comprises:

a hand grip; and a hand guard.

13. The clipper comb as in claim 9 wherein the activation means is comprised of a button.

14. The clipper comb as in claim 13 wherein the button is a double depression button.

15. The clipper comb as in claim 13 wherein the button is a variable depth depression button for varying the speed of the motor in direct proportion to the depth of the button depression.

16. The clipper comb as in claim 9 wherein the trailing edge is sharpened.

17. The clipper comb as in claim 9 further comprising a battery, disposed within the handle, for powering the motor.

18. The clipper comb as in claim 9 wherein the comb and the first shaft are removably attachable to the handle.

19. The clipper comb as in claim 9 further comprising an end cap removably attached to the second end.

* * * * *